US005124016A

United States Patent [19]

Barbier

[11] Patent Number: 5,124,016

[45] Date of Patent: Jun. 23, 1992

[54] ELECTROPLATING APPARATUS

[75] Inventor: Jean-Marc Barbier, Pontenet, Switzerland

[73] Assignee: Elga SA, Bienne, Switzerland

[21] Appl. No.: 601,369

[22] Filed: Oct. 23, 1990

[30] Foreign Application Priority Data

Oct. 23, 1989 [EP] European Pat. Off. ..... 89810794.1

[51] Int. Cl.[5] ..... C25D 17/26

[52] U.S. Cl. ..... 204/222; 204/287

[58] Field of Search ..... 204/222, 287; 366/114, 366/127, 600; 198/757, 769

[56] References Cited

U.S. PATENT DOCUMENTS

| | | | |
|---|---|---|---|
| 3,397,126 | 8/1968 | Gilbert | 204/222 X |
| 3,751,343 | 8/1973 | Macula et al. | 204/222 X |
| 3,862,745 | 1/1975 | Chiz | 204/222 X |
| 4,658,953 | 4/1987 | Schopfer et al. | 198/757 |

*Primary Examiner*—Donald R. Valentine

*Attorney, Agent, or Firm*—Marks & Murase

[57] ABSTRACT

In the electroplating apparatus, which consists of a rod which links a vibrator to a basket, the vibrator comprising at least a baseplate, an electromagnet, a vibrating plate and a supporting device, and the basket being connected to the rod by means of braces, the air gap is directly formed by the space between the lower base of the electromagnet and the top surface of the baseplate. Adjustment of the air gap is effected by means of a spindle and without disassembling the springs; the air gap is automatically uniform over the entire surface of the core.

The electroplating apparatus is further characterized by the fact that cathode current transfer is ensured directly by the rod, which is a solid piece of metal, possibly having recesses and preferably consisting of aluminum. The carrying device comprises two shanks which are insulated from vibrations. The cover of the vibrator is made of polypropylene, which provides a better tightness and excludes all risks of corrosion.

24 Claims, 2 Drawing Sheets

ELECTROPLATING APPARATUS

BACKGROUND OF THE INVENTION

The present invention refers to an electroplating apparatus, consisting of a rod which links a vibrator to a basket, said vibrator comprising at least a baseplate, an electromagnet, a vibrating plate and a supporting device, said basket being connected to said rod by means of braces.

Such apparatuses are in principle already known in the electroplating industry. Small pieces to be electroplated are arranged in said basket, the basket is immersed into an electrolyte, and a direct electroplating current is established between the basket of the apparatus, connected as a cathode, and an appropriate anode outside the apparatus.

Known apparatuses of this kind, e.g. from U.S. Pat. No. 3,397,126 (Gilbert) or from SU-A-1 108 141, have two major drawbacks, one being their poor efficiency which decreases very quickly after a relatively short time of operation, and the other being their low reliability, these drawbacks being related to correct vibration.

The causes for this unsatisfactory operation of known apparatuses are at least four. The first problem concerns the air gap or interferric space between the pole pieces of the electromagnet which must be periodically adjusted. In known apparatuses having an intermediate plate between the electromagnet and the vibrating plate, this adjustment is delicate, time-consuming, and thus expensive. It requires disassembly of springs connecting the vibrating plate to the baseplate, and subsequent step-by-step adjustment of a stopper screw in a support member connecting the electromagnet to the baseplate. This adjustment is rendered even more delicate by the fact that the air gap between the pole pieces, normally about 0.35 mm, must be rigorously uniform. Consequently, the operator of the known devices must proceed by successive trials until the required uniformity is obtained. After the adjustment has been effected, the above-mentioned springs have to be reassembled.

The second problem lies in the transfer of the cathodic current. It is generally provided by a very small plug which is arranged beneath the vibrating plate and fitted in a member to which the conductive wires are connected. These conductive wires, the opposite ends of which are connected to the braces, extend in a hollow portion of the rod which links the vibrator to the basket and which accordingly has the form of a tube. It has been found that, on one hand, the current transmitting plug breaks easily when the basket has to be removed, e.g. in view of adjusting the air gap. On the other hand, the arrangement is such that it limits the fields of application considerably since the intensity of the cathode current should not exceed 10 A.

The third point contributing to the poor efficiency and impairing the reliability of the known apparatuses is the suspension device of the apparatus, i.e. a hook. Actually, transmission of the vibrations of the vibrator to the hook must be eliminated nearly totally. In the known devices, the hook is axially connected to the base plate.

Finally, the fourth problem of the known apparatuses concerns the tightness of the vibrator casing. In the known devices, the cover resp. the casing of the vibrator is made of aluminum. In particular, the casing is laterally screwed to an upper closing plate and to the base plate. However, redox processes are caused very quickly by the contact of the screws with the casing aluminum, and the resulting corrosion will impair the tightness of the casing.

OBJECTS OF THE INVENTION

It is a first and major object of this invention to provide a new and improved electroplating apparatus, especially for the electroplating of small workpieces, which does not show the drawbacks discussed above of known devices.

Another object of the invention is to provide an electroplating apparatus having the best efficiency and excellent reliability, expressed in terms of vibration.

Still another object of the invention is to provide an electroplating apparatus which does not request the periodical readjustment of the vibrator.

A still further object of the invention is to provide an electroplating apparatus where the vibrator casing is absolutely tight and will not undergo corrosion even under severe environmental conditions, as they are often found in electroplating plants.

Finally, a further object of the invention is to provide an electroplating apparatus wherein the transfer of the cathodic current is not impaired.

SUMMARY OF THE INVENTION

These and still other objects of the invention are met and accomplished by the electroplating apparatus described herein. It distinguishes itself by the fact that the air gap or interferric space of the vibrator device is formed directly by the space between the lower base of the electromagnet and the vibrating plate. The electromagnet is axially mounted in the baseplate of the vibrator, preferably by means of a support. Any adjustment of the air gap may be obtained by rotating the electromagnet about its axis, and after readjustment, the electromagnet is blocked by a stopping means. The electromagnet may have any shape, such as of a cylinder or a parallelepiped.

The cathodic contact may be ensured by the rod and braces which connect the rod to the basket. The rod is a solid metal piece, preferably of aluminum, which may be provided with recesses.

Other features, characters and advantages of the invention will become apparent from the following description of preferred embodiments.

SHORT DESCRIPTION OF THE DRAWINGS

The mounting and adjusting device for the electromagnet, respectively its air gap, will be explained with reference to FIGS. 1, 2, 3, and 4.

DETAILED DESCRIPTION OF THE DRAWINGS

Figure 3:
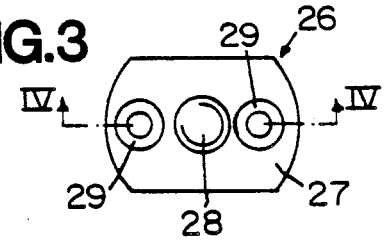
FIGS. 3 and 4 show the support of the electromagnet.
Figure 4:
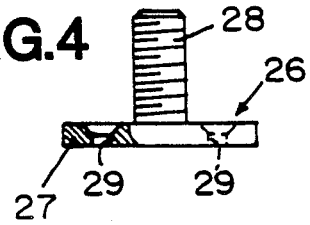

Electromagnet 25 is attached to baseplate 24 by means of support 26 shown in FIGS. 3 and 4. Said support consists of a plate 27 and a spindle 28 and comprises countersunk holes 29. The support is fixed on the upper base of the electromagnet by means of flat head screws 30 extending in countersunk holes 29, spindle 28 being directed vertically upwards. The axes of spindle 28, of electromagnet 25, and base plate 24 are all identical, i.e. they coincide with symmetrical axis 50 of apparatus 1.

The block formed by support 26 and electromagnet 25 is screwed into a corresponding central threaded bore of base plate 24 by spindle 28.

According to the invention, air gap 35 is the space between the lower base of electromagnet 25 and vibrating plate 23, i.e. the latter constitutes a pole piece at the same time.

The size of the air gap, which is 0.35 mm in the present field of application, is adjustable very easily by slightly rotating the block formed by electromagnet 25 and support 26 in order to obtain a greater or lesser aperture. As soon as the measuring gauge indicates the exact size of the air gap, electromagnet 26 is blocked with respect to screw 28 by a stopper (not shown). Said stopper may be e.g. a threaded element which is radially screwed into the baseplate.

Since the adjustment is effected by rotation around axis 50, any parallax error is excluded. The air gap of 0.35 mm is thus automatically uniform over the entire lower surface of the electromagnet core.

Moreover it has been found that the air gap adjustment frequency is considerably reduced. This advantage results from the excellent uniformity of the air gap. Besides, even if there is a slight loss of adjustment, the harmful effects thereof are considerably reduced, i.e. the decrease of efficiency does not take such proportions as known in existing apparatus.

It further appears that disassembly of elastic return members 31 connecting vibrating plate 23 to base plate 24 in a known manner is no longer necessary.

The electromagnet may have the known parallelepipedal configuration. In an alternative embodiment, which is not shown, an electromagnet having a circular cross-section, i.e. a cylindrical form is used, the efficiency of which is somewhat superior.

Another characteristic of the invention contributing to an optimisation of the efficiency of the electroplating apparatus is that of the cathode current transfer mode. Actually, the connecting plug screwed into the vibrating plate as well as the conductive wires extending in a tube-shaped rod which carries the basket, as provided in known devices, are replaced.

First of all, the current is supplied directly from the carrying device, i.e. from hook 21 (which will be discussed below), to vibrating plate 23 by means of two conducting wires 36 screwed onto vibrating plate 23 by a respective terminal which is illustrated but not referenced, and by a respective screw 37. Said two wires 36 are in contact with end portions 22 of hook 21 via terminals 38.

The current is then transferred to a solid metallic bearing piece 11 and thence to rod 2 which itself is a solid metallic piece as well. Said bearing piece and rod act as conductors, the current being supplied to braces 4 provided with bolts 5, which are inserted in bores 6 of the rod, and consequently to hollow cathode screws 32. Bottom 34 of basket 3 is fixed with respect to braces 4 by means of plastic screws 33.

Figure 1:
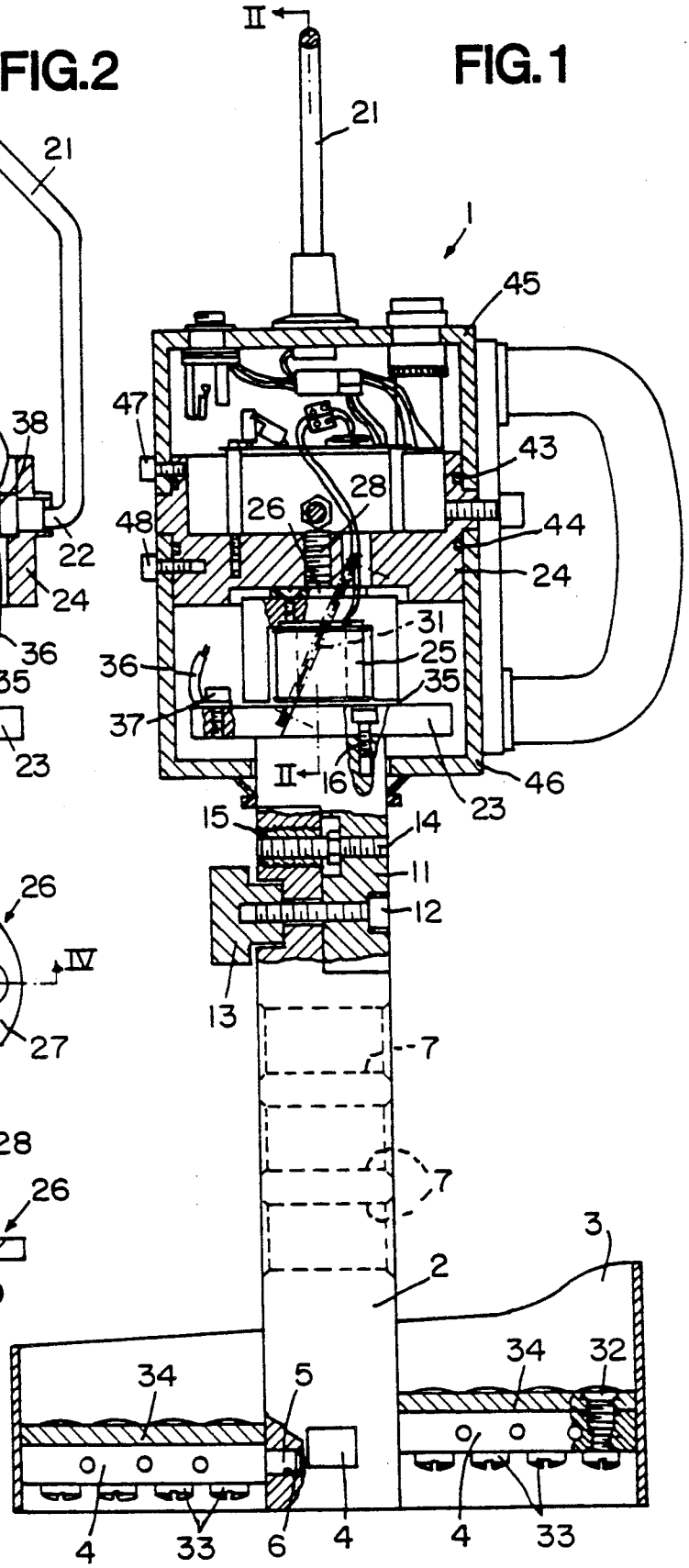
FIG. 1 is a partly sectioned general view of the electroplating apparatus.
Figure 6:
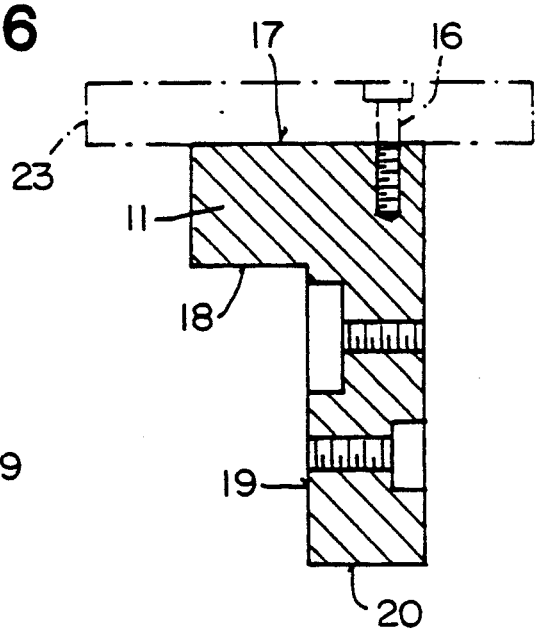
FIGS. 5 and 6 are detailed illustrations of the rod and its bearing piece.
Figure 5:
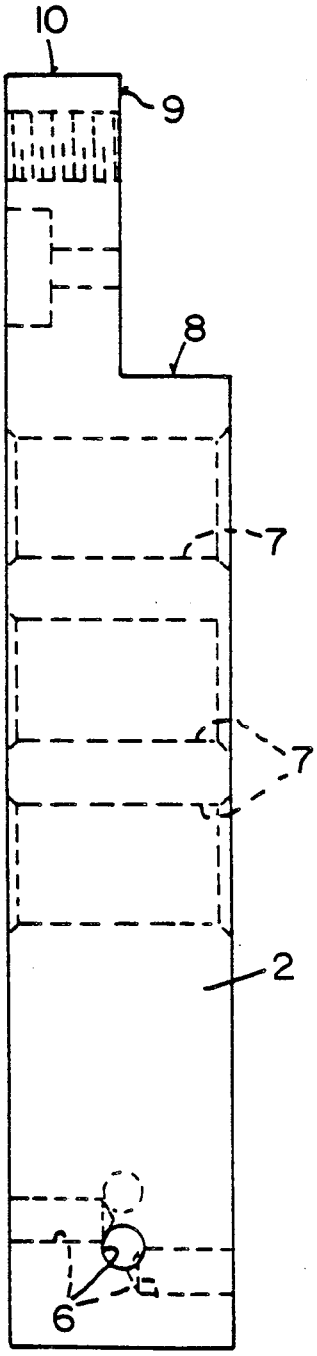

FIGS. 5 and 6 show an embodiment of rod 2 and of bearing 11 in detail. Vibrating plate 23 bears against surface 17 of bearing piece 11 and is screwed thereto by means of three screws 16 (FIG. 1 and 6). Rod 2 and bearing piece 11, which are destined to be assembled, comprise two complementary shoulders 8 and 9 (FIG. 5) and 18 and 19 (FIG. 6), respectively.

During assembly, surfaces 18,19,20 of bearing piece 11 are brought together with respective surfaces 10,9,8 of rod 2.

Attachment of rod 2 with bearing 11 is obtained by means of two elements; first, a securing and centering element comprising a partly threaded bolt 14 fixed by a nut which is shown but not referenced, and a bushing 15 in which the non-threaded portion of said bolt extends (FIG. 1); and further a locking element comprising a screw 12 and an operating handle 13.

The cathode contact is thus provided directly by rod 2 and braces 4. The cathode current is supplied to the rod by means of a connection of end portions 22 of hook 21 to vibrating plate 23 by means of wires 36. This construction excludes all risks of a broken connecting plug while its weight is low, bearing 11 and rod 2, which may in addition be provided with recesses 7 (FIG. 5), preferably being made of aluminum.

Above all, the field of applications of the electroplating apparatus according to the invention is substantially extended since the described current supply allows transmission of cathode currents as high as 100 A.

Another particularity of the apparatus consists in providing a carrying means 21 which is laterally connected to the vibrator.

Figure 2:
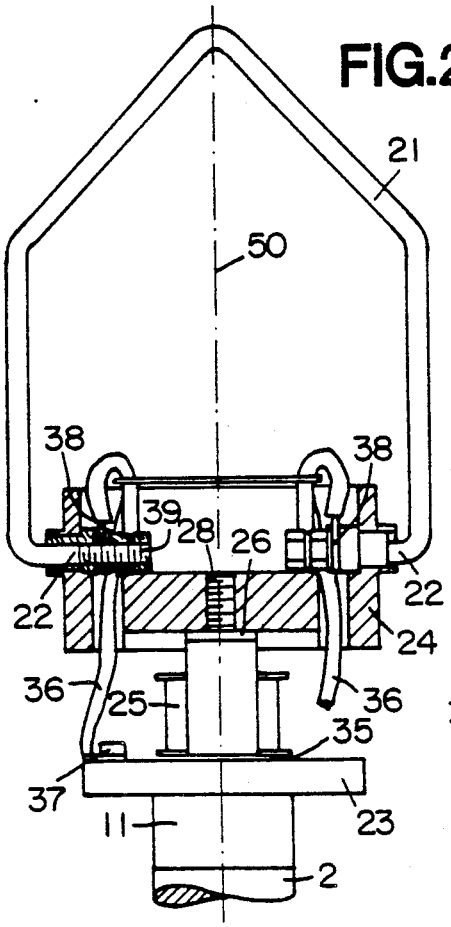
FIG. 2 is a cross-section according to axis II in FIG. 1.

The configuration of this carrying device appears in FIG. 2. Said carrying device forms a hook having the shape of a reversed V the shanks of which extend in parallel to the symmetrical axis of said V over a certain length and are then bent inwardly towards said symmetrical axis and perpendicularly thereto. The bent portions, or end portions, are referenced 22 and terminated by threaded portions 39.

Said hook is connected to the vibrator by vibration-absorbing means, i.e. by dampers, in such a manner that the hook is insulated from vibrations and almost motionless during operation.

In the illustrated example, these vibration absorbing means are rubber wire bushings.

It appears that end portions 22 of the hook are connected to the vibrator at two diametrically opposed points and that said wire bushings are attached to end portions 22; they are thus disposed between openings which are not referenced and which extend radially in baseplate 24, and said end portions 22.

A known nut/counter-nut and washer arrangement, which is not referenced, secures the hook and the terminal 38 of electric wire 36 by a clamping effect against a flange of said wire bushing.

In an alternative embodiment which is not shown, said absorbing means are disposed on the outside in the lower area of the parallel shanks of hook 21, i.e. near end portions 22 which, in this case, would then be secured either directly to base plate 24 or, alternatively, in the upper area of said parallel shanks. Said means comprise springs acting by compression or resilient metallic disks forming a bellows.

Finally, the cover of the vibrator constitutes a last particularity of the electroplating apparatus of the invention. As opposed to known apparatus, the protection of which is provided by an aluminum casing, the vibrator is wrapped in a plastics cover which is advantageously made of polypropylene. In the shown example, the protection consists of a top cover 45 and a bottom cover 46. The interior elements of the vibrator are protected from splashing electrolyte by sealing members 43,44, preferably 0-rings which are disposed between said covers and baseplate 24. Finally, the covers are screwed to the baseplate by means of stainless screws 47,48. Since the latter are in contact with the polypropylene material on the outside, any redox phenomena and thus any corrosion are excluded.

The measures taken according to the invention provide rational and inexpensive solutions to the problems of efficiency and reliability in electroplating apparatuses. Moreover, the field of applications of the apparatus according to the invention is considerably enlarged.

What I claim is:

1. An electroplating apparatus, consisting of a rod which links a vibrator to a basket and means for supplying an electrical current to said basket, said vibrator comprising at least a baseplate, an electromagnet having a horizontal base on each of its ends, an air gap being provided between said electromagnet and said baseplate, a vibrating plate and a supporting device, said basket being connected to said rod by means of braces, wherein said air gap is formed directly by the space between the lower base of said electromagnet and said vibrating plate.

2. An electroplating apparatus according to claim 1, wherein said electromagnet is axially mounted in the baseplate.

3. An electroplating apparatus according to claim 2, wherein said mounting of said electromagnet is effected by means of a support.

4. An electroplating apparatus according to claim 3, wherein the adjustment of said air gap is obtained by rotating said electromagnet around its axis.

5. An electroplating apparatus according to claim 4, wherein a stopping means blocks said electromagnet after the adjustment of said air gap has been effected.

6. An electroplating apparatus according to claim 1, wherein said electromagnet is a parallelepipedical block.

7. An electroplating apparatus according to claim 1, wherein said electromagnet is a cylindrical block.

8. An electroplating apparatus, comprising a rod which links a vibrator to a basket, said vibrator comprising at least a baseplate, an electromagnet, a vibrating plate and a supporting device, said basket being connected to said supporting device by means of braces, wherein said supporting device comprises a hook, a cathode contact of said electroplating apparatus being ensured by said supporting device and said braces.

9. An electroplating apparatus according to claim 8, wherein said rod consists of a solid metallic piece optionally having recesses.

10. An electroplating apparatus according to claim 9, wherein said metallic piece is formed of aluminum.

11. An electroplating apparatus according to claim 8, wherein a supply of a cathode current to said supporting device is ensured by a connection between said hook and said vibrating plate.

12. An electroplating apparatus according to claim 8, wherein said vibrating plate is secured to said rod by means of a bearing piece.

13. An electroplating apparatus according to claim 12, wherein said bearing piece is a solid metallic piece.

14. An electroplating apparatus according to claim 12, wherein said bearing piece comprises a shoulder which bears upon a complementary shoulder of the top end of said rod, and wherein said bearing piece and said rod are attached to each other by radial connecting means.

15. An electroplating apparatus according to claim 8, wherein said braces are inserted into the bottom portion of said rod.

16. An electroplating apparatus according to claim 8, further comprising vibration absorbing means to hinder vibrations from being transmitted to said carrying device.

17. An electroplating apparatus according to claim 16, wherein said carrying device is a hook comprising two shanks whose end portions are connected to said vibrator at two diametrically opposed points by means of said vibration absorbing means.

18. An electroplating apparatus according to claim 17, wherein said end portions are terminated by threaded portions and extend perpendicularly to the axis of said vibrator, and wherein they pass through diametrically opposed openings of said baseplate.

19. An electroplating apparatus according to claim 18, wherein said vibration absorbing means are disposed between said opening of said baseplate and said end portions of said hook.

20. An electroplating apparatus according to claim 18, wherein said absorbing means are disposed on said shanks of said hook.

21. An electroplating apparatus according to claim 18, wherein said end portions of said hook are secured by means of clamping devices, and wherein said clamping devices are not in direct contact with said base plate.

22. An electroplating apparatus according to claim 8, wherein said vibrator comprises a tight protection cover made of plastics material, preferably of polypropylene.

23. An electroplating apparatus according to claim 22, wherein said protection cover consists of a top cover and a bottom cover.

24. An electroplating apparatus according to claim 23, wherein sealing means preserve the interior elements of said vibrator from any contact with corrosive agents.

* * * * *